US006919753B2

(12) United States Patent
Wang et al.

(10) Patent No.: US 6,919,753 B2
(45) Date of Patent: Jul. 19, 2005

(54) TEMPERATURE INDEPENDENT CMOS REFERENCE VOLTAGE CIRCUIT FOR LOW-VOLTAGE APPLICATIONS

(75) Inventors: Jin-sheng Wang, Plano, TX (US); Wenliang Chen, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/649,221

(22) Filed: Aug. 25, 2003

(65) Prior Publication Data

US 2005/0046470 A1 Mar. 3, 2005

(51) Int. Cl.[7] ..... G05F 1/10
(52) U.S. Cl. ..... 327/513; 327/543
(58) Field of Search ..... 327/512, 513, 327/530, 534, 535, 538, 539, 540, 541, 543

(56) References Cited

U.S. PATENT DOCUMENTS 5,467,052 A * 11/1995 Tsukada ..... 327/543
5,859,560 A * 1/1999 Matthews ..... 327/513
6,150,871 A * 11/2000 Yee ..... 327/538
6,348,832 B1 * 2/2002 Chih ..... 327/538
6,724,244 B2 * 4/2004 Wu ..... 327/543
6,737,909 B2 * 5/2004 Jaussi et al. ..... 327/541
6,759,893 B2 * 7/2004 Gailhard et al. ..... 327/513

* cited by examiner

*Primary Examiner*—Jeffrey Zweizig
(74) *Attorney, Agent, or Firm*—Ronald O. Neerings; Wade James Brady, III; Frederick J. Telecky, Jr.

(57) ABSTRACT

A temperature independent CMOS reference voltage circuit includes a CMOS current mirror circuit containing first and second CMOS transistors of a first polarity. A temperature compensation circuit is coupled to the CMOS current mirror circuit, and contains a first resistor, a second resistor, and third and fourth CMOS transistors of a second polarity. The third and fourth CMOS transistors are configured to operate substantially in a subthreshold region. One of the third and fourth CMOS transistors is diode connected.

25 Claims, 3 Drawing Sheets

TEMPERATURE INDEPENDENT CMOS REFERENCE VOLTAGE CIRCUIT FOR LOW-VOLTAGE APPLICATIONS

FIELD OF THE INVENTION

The present invention relates to reference voltage generators, and more particularly relates to a CMOS reference voltage circuit that is temperature-independent for low-voltage applications.

BACKGROUND OF THE INVENTION

In many electronic applications; a reference voltage having a very low temperature coefficient is required. Band-gap voltage reference circuits have been developed to fulfill this need. The nominal temperature coefficient (TC) of a silicon diode is −2 mV/° C. However, TC is inversely proportional to the current density J in the diode. By manipulating the current densities through two diodes and taking the difference in forward bias voltages, one can create a circuit with a well-defined positive TC. This is then added to the forward bias voltage of a third diode. The positive TC of the diode pair cancels the negative TC of the third diode and one is left with a circuit with zero TC.

Referring to band-gap voltage reference circuits having bipolar transistors, FIG. 1 depicts a conventional bandgap circuit 100. The circuit 100 contains two bipolar transistors 102 and 104. The two bipolar transistors 102 and 104 have voltages $V_{BE}$ and $\Delta V_{BE}$ in relation. $V_{BE}$ has a negative temperature coefficient, which is −2 mV/C. $\Delta V_{BE}$ has a positive temperature coefficient, which depends on the current density of the two bipolar transistors 102 and 104. The relation is expressed by the following equation:

$$\Delta V_{BE}=(KT/q)*\ln(J2/J1)$$

The bandgap circuit 100 operates by using PTAT and CTAT currents from two branches to derive a constant current into the resistor, which generates a constant reference voltage. In circuit 100, three resistors 106, 108 and 110 must be matched. Thus, the conventional bandgap circuit 100 is a complex circuit.

Further, there are many PMOS and NMOS transistors that need to be matched to obtain a low temperature-dependent reference voltage. Accordingly, a need exists for a simplified temperature-independent reference voltage circuit.

In view of the foregoing, a need exists to overcome the problems with the prior art as discussed above.

SUMMARY OF THE INVENTION

In accordance with the present invention, a temperature independent CMOS reference voltage circuit includes a CMOS current mirror circuit containing first and second CMOS transistors of a first polarity. A temperature compensation circuit is coupled to the CMOS current mirror circuit, and contains a first resistor, a second resistor, and third and fourth CMOS transistors of a second polarity. The third and fourth CMOS transistors are configured to operate substantially in a subthreshold region. One of the third and fourth CMOS transistors is diode connected.

BRIEF DESCRIPTION OF THE DRAWINGS

Other aspects and features of the present invention and many of the attendant advantages of the present invention will be readily appreciated as the same become better understood by reference to the following detailed description when considered in connection with the accompanying drawings in which like reference numerals designate like parts throughout the figures thereof and wherein.

While the above-identified drawing figures set forth particular embodiments, other embodiments of the present invention are also contemplated, as noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DETAILED DESCRIPTION

The present invention, according to one embodiment, overcomes problems with the prior art while reducing the size and power required for the operation of the circuit.

Reference throughout the specification to "one embodiment" means that a particular feature, structure, or characteristic described in connection with the embodiment is included in at least one embodiment of the present invention. Thus, the appearances of the phrases "in one embodiment" in various places throughout the specification are not necessarily all referring to the same embodiment. Furthermore, the particular features, structures, or characteristics may be combined in any suitable manner in one or more embodiments. Moreover, these embodiments are only examples of the many advantageous uses of the innovative teachings herein. In general, statements made in the specification of the present application do not necessarily limit any of the various claimed inventions. Moreover, some statements may apply to some inventive features, but not to others. In general, unless otherwise indicated, singular elements may be in the plural and visa versa with no loss of generality.

Figure 1:
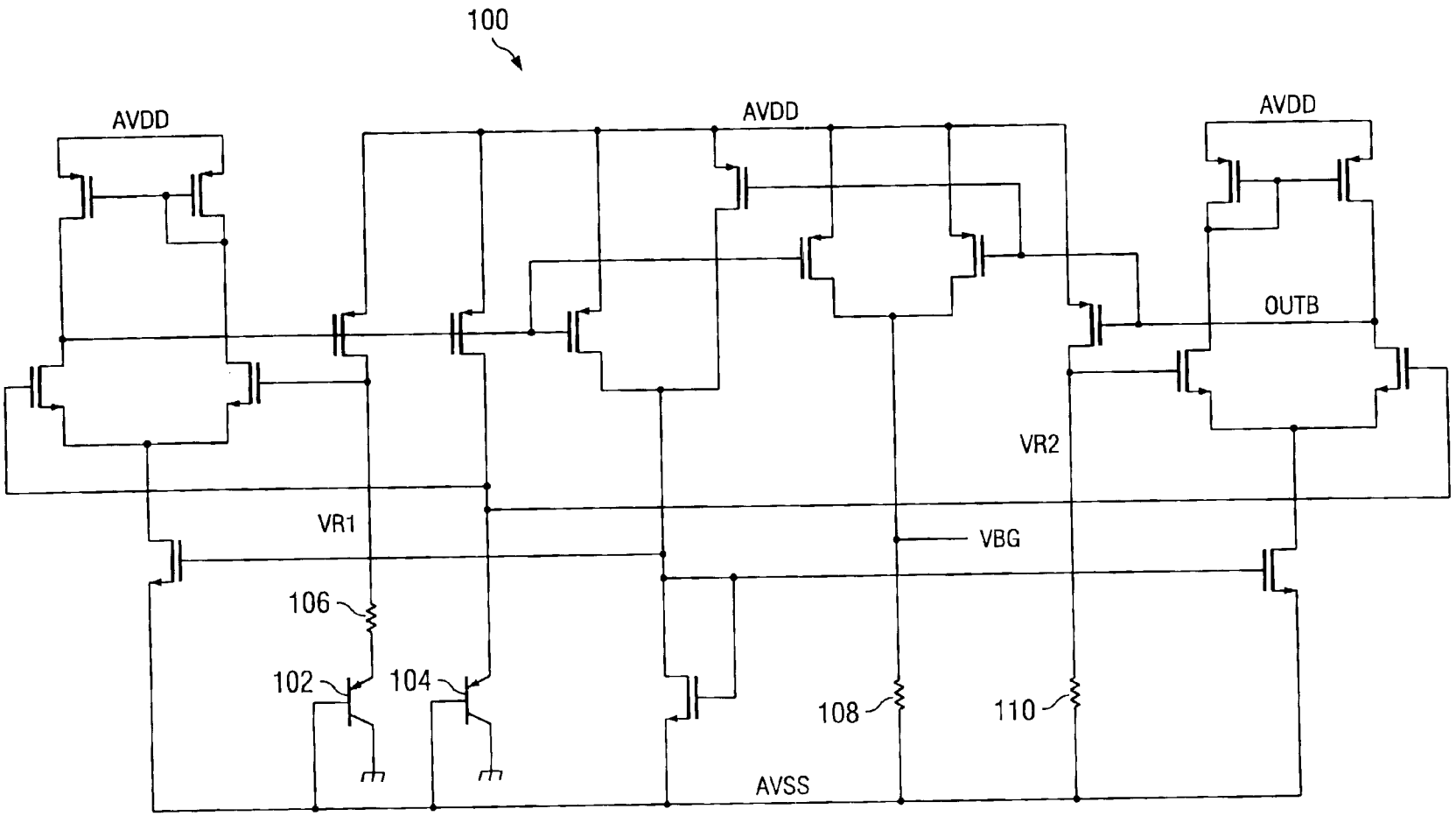
FIG. 1 (PRIOR ART)
FIG. 1 is a schematic diagram illustrating a conventional bandgap circuit having typical bipolar transistors.
Figure 2:
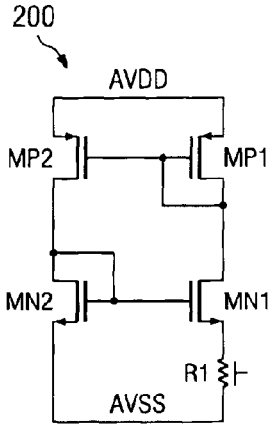
FIG. 2 (PRIOR ART)
FIG. 2 is a schematic diagram of a conventional reference current circuit.

Turning now to FIG. 2, there is shown a conventional PTAT-current circuit that generates an output current with an accuracy of about +/−25% or higher.

Implementation Embodiment in Hardware

Figure 3:
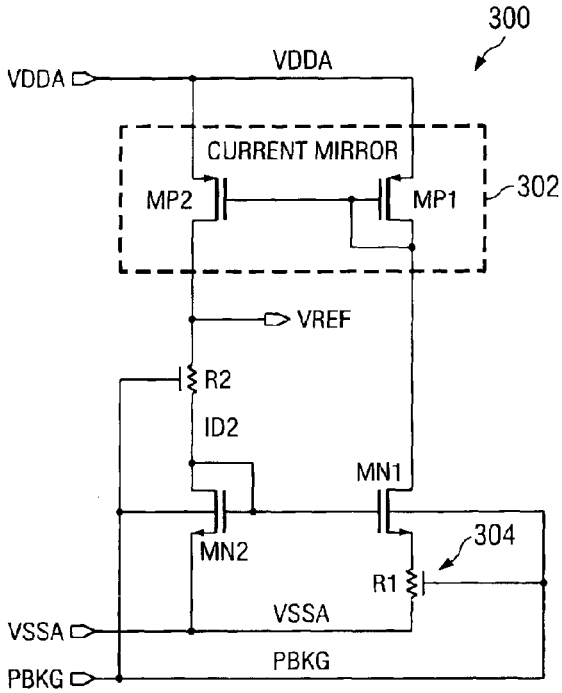
FIG. 3 is a schematic diagram showing a CMOS temperature independent voltage reference circuit according to one embodiment of the present invention.

According to one embodiment of the present invention, as shown in FIG. 3, the CMOS temperature independent voltage reference circuit 300 contains two PMOS transistors MP1, MP2, two NMOS transistors MN1, MN2, and two resistors R1 and R2. The current mirror circuit 302 is formed by the two PMOS transistors MP1 and MP2. The temperature compensation circuit 304 contains the two NMOS transistors MN1, MN2, and the two resistors R1 and R2.

In an embodiment, the resistors R1 and R2 are variable. The resistor R1 is coupled between the sources of the two NMOS transistors MN1, MN2. The gates of the NMOS transistors MN1, MN2 transistors are interconnected.

In accordance with the present invention, a first side of the resistor R1 is coupled to the drain of the CMOS transistor MN2, and a second side of the resistor R1 is coupled to the CMOS current mirror circuit 302.

Further, the temperature compensation circuit 304 is configured so as to generate a reference voltage, $V_{ref}$, containing a proportional to absolute temperature (PTAT) voltage component, and a threshold voltage of the NMOS transistor MN2, as explained below.

The CMOS temperature independent voltage reference circuit 300 is configured so as to operate the two NMOS transistors MN1 and MN2 near subthreshold regions. One of the NMOS transistors MN1 and MN2 is diode-connected (i.e., drain is connected to gate). For example, in an embodiment, the NMOS transistor MN2 is diode connected. Accordingly, a small current is needed to operate the transistor MN2 near the subthreshold region. Therefore, the NMOS transistors MN1 and MN2, which are operated near the subthreshold regions, behave like bipolar transistors, and subthreshold MOS current formula is applied to derive the temperature-independent reference voltage $V_{ref}$. The derivation is shown below, as set forth in equation (1):

From KVL rules, $$V_{ref}=I_{D2}R_2+V_{GS2} \quad \text{Eq(1)}$$

where $V_{ref}$ is the reference voltage, $I_{D2}$ is the drain current and $V_{GS2}$ is the gate-to-source voltage of the NMOS transistor MN2.

If $V_{GS2}=V_{t2}$ (i.e., transistor MN2's threshold voltage), it implies that the NMOS transistor MN2 is very close to the subthreshold region.

Again, from KVL rules:

$$V\text{ref}=I_{D2}R_2+V_{t2} \quad \text{Eq (2)}$$

$$V_{GS1}+I_{D1}R_1=V_{GS2} \quad \text{Eq (3)}$$

If the NMOS transistors MN1 and MN2 are in the subthreshold region, their drain currents are defined as shown below:

$$I_D=\frac{W}{L}I_{D0}\exp\left(\frac{V_{GS}-V_t}{nV_T}\right) \quad \text{Eq (4)}$$

where $$V_T=\frac{kT}{q},$$

k is Boltzman's constant and Vt is the threshold voltage of MOS transistor.

Assuming $$\alpha=\frac{W}{L}I_{D0},$$

Equation (4) becomes:

$$I_D=\alpha\exp\left(\frac{V_{GS}-V_t}{nV_T}\right) \quad \text{Eq (5)}$$

$$V_{GS}=nV_T\ln\left(\frac{I_D}{\alpha}\right)+V_t \quad \text{Eq (6)}$$

Solving equations (3) and (6) yields:

$$nV_T\ln\left(\frac{I_{D1}}{\alpha_1}\right)+I_{D1}R_1=nV_T\ln\left(\frac{I_{D2}}{\alpha_2}\right) \quad \text{Eq (7)}$$

$$I_{D1}R_1=nV_T\ln\left(\frac{I_{D2}\alpha_1}{I_{D1}\alpha_2}\right) \quad \text{Eq (8)}$$

If $I_{D1}=I_{D2}=I_D$, by design, then equation (8) becomes:

$$I_D=\frac{nV_T}{R_1}\ln\left[\frac{(W/L)_1}{(W/L)_2}\right] \quad \text{Eq (9)}$$

Solving equations (2) and (9) yields:

$$V_{ref}=nV_T\left(\frac{R_2}{R_1}\right)\ln\left[\frac{(W/L)_1}{(W/L)_2}\right]+V_{t2} \quad \text{Eq (10)}$$

$$V_{ref}=\frac{nkT}{q}\left(\frac{R_2}{R_1}\right)\ln\left[\frac{(W/L)_1}{(W/L)_2}\right]+V_{t2}$$

where n is a constant, 1<n<2, k is Boltzman's constant, and q is charge.

In equation (10), the first term on the right hand side is "proportional to absolute temperature (PTAT) voltage", which has a positive temperature coefficient. The second term is threshold voltage of the NMOS transistor, which has a negative temperature coefficient. Thus, equation (10) describes a reference voltage, which has a very small temperature-dependence, similar to a conventional bandgap reference voltage.

Thus, as shown above in equation (10), Vref is determined only by the ratios of NMOS transistors MN1, MN2 and resistors R1, R2. If the NMOS transistors MN1, MN2 and resistors R1, R2 are matched well, Vref does not change according to the type of NMOS transistors used or the absolute value of the resistance.

Accordingly, the present invention also includes a complementary circuit, in an embodiment, with PMOS transistors working substantially in the sub-threshold regions and NMOS transistors functioning as current mirrors.

Further, the current mirror circuit 302 is a simplified circuit. It can be replaced, in other embodiments, by other circuits such as a cascode circuit and a gain boosted circuit, in order to increase the power supply rejection ratio (PSRR) of the circuits.

In addition, in other embodiments, the circuit 300 of the present invention is coupled with a non-illustrated circuit substrate so as to form an integrated circuit.

Regarding Vt, the threshold voltage of the MOS transistor is defined in equation (11), as shown below:

$$V_t=V_{to}-\alpha(T-T_o) \quad (11)$$

where $V_{to}$ is the threshold voltage at absolute temperature= 0, To=0 K and $\alpha$ is the proportional constant. $\alpha$ changes with process nodes, and a typical example is given below.

Design Example

A real design example in the 1233C027 process is included below for demonstrative purposes. Simulation was also run in the 1833C05 process, and it showed a similar temperature-independent behavior.

Figure 4:
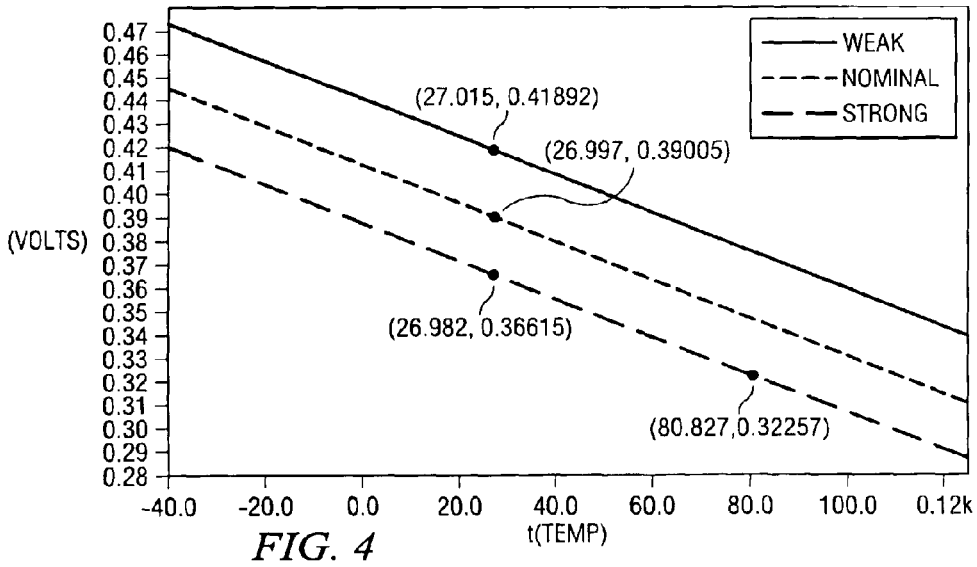
FIG. 4 is a graph showing simulation results of Vt's temperature coefficient for the circuit of FIG. 3, according to one embodiment of the present invention.
Figure 5:
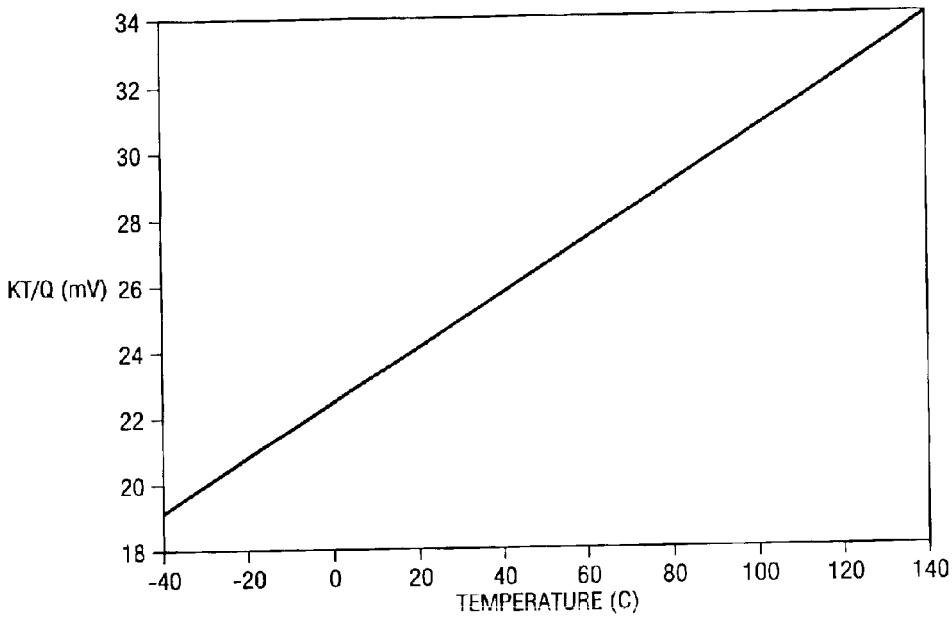
FIG. 5 is a graph showing simulation results of the temperature coefficient for proportional-to-absolute-temperature (PTAT) voltage for the circuit of FIG. 3, according to one embodiment of the present invention.
Figure 6:
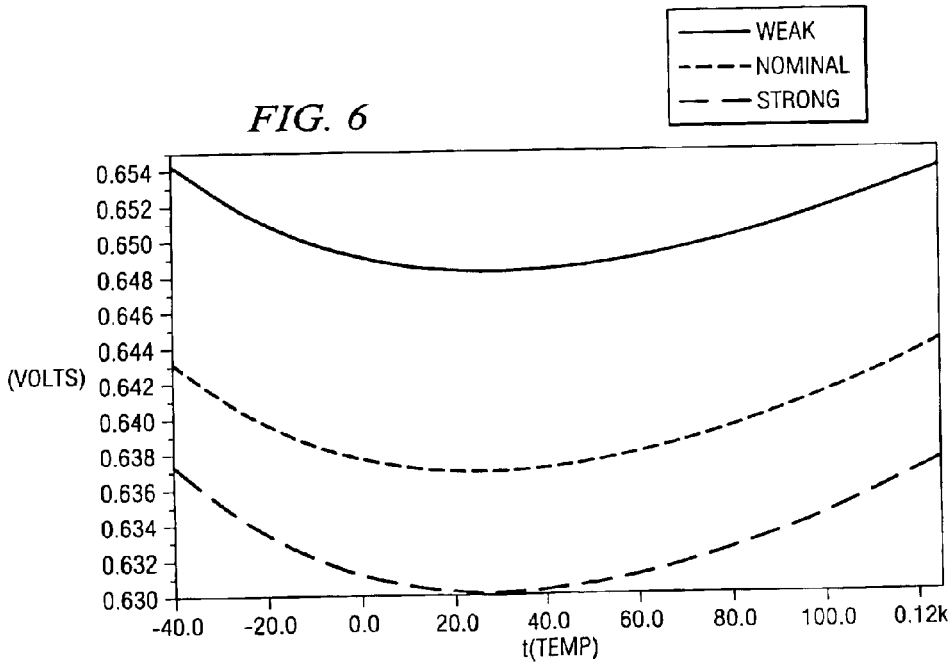
FIG. 6 is a graph illustrating simulation results of Vref versus temperature for the circuit of FIG. 3, according to one embodiment of the present invention.

FIG. 4 is a graph showing the simulation results of Vt's temperature coefficient for the circuit 300 according to one embodiment of the present invention. FIG. 5 is a graph showing the simulation results of the temperature coefficient for proportional-to-absolute-temperature (PTAT) voltage for the circuit 300. FIG. 6 is a graph illustrating the simulation results of Vref versus temperature for the circuit 300.

a) Temperature Coefficients:

Simulations over a temperature range were used to verify the design. For the C027 process, it is found from the simulation that $V_t$'s temperature coefficient is approximately equal to 0.8 mV/C, as shown in FIG. 4; and k/q is approximately equal to +0.08 mV/C (i.e., the temperature coefficient for the PTAT voltage), as shown in FIG. 5.

b) Calculation of Device and Resistor Ratios:

From part a), the temperature coefficients of the Vt and PTAT voltages have been calculated using SPICE simulation, which are applied to equation (10) for calculating the ratios of the NMOS transistors MN1–MN2 and resistors R1–R2 in order to obtain the minimal temperature variation of Vref. In the following design case, circuit specifications are targeted as shown below:

Voltage Reference Specifications:

Vref~640 mV at 27 degrees C.

Current consumption<10 uA

Supply Voltage~1.3 V

Temperature coefficient of Vref<50 ppm/C

Accordingly, the drain current is partitioned to be 4 uA in each leg. From FIG. 4, it can be seen that Vt is 0.395 V at 27 degrees C. Thus, R2 needs to be around 60 kohms to achieve the desired Vref. $(W/L)_1/(W/L)_2$ can be chosen as 8 to keep the NMOS transistor close to the subthreshold region. The ratio of R2/R1 is about 3.53 to get a reference voltage with minimized temperature dependence. From the simulation results, as is illustrated in FIG. 6, the temperature variation is about 43 ppm over the range of −40 to 125 deg C.

The original layout area for the C035 version is about 400 um*400 um. However, in this design it is only about 110 um*110 um, including the test pad (70 um*60 um). The area is reduced and the current is also reduced from 20 uA to 10 uA within the same specification, +/−5% variation of the Vref. Therefore, the size of the reference circuit and the power are reduced. This is very helpful for low voltage mixed-signal applications.

Thus, advantageously, the present invention realizes a low power and low current circuit, without any bipolar transistor, while generating a stable reference voltage, similar to a bandgap voltage generator.

Non-Limiting Embodiments

In view of the above, it can be seen the present invention presents a significant advancement in the art of reference voltage circuit technology. Further, this invention has been described in considerable detail in order to provide those skilled in the data communication art with the information needed to apply the novel principles and to construct and use such specialized components as are required. In view of the foregoing descriptions, it should further be apparent that the present invention represents a significant departure from the prior art in construction and operation. However, while particular embodiments of the present invention have been described herein in detail, it is to be understood that various alterations, modifications and substitutions can be made therein without departing in any way from the spirit and scope of the present invention, as defined in the claims which follow.

What is claimed is:

1. A CMOS reference voltage circuit, comprising:

a current mirror circuit comprising first and second transistors of a first polarity;

a temperature compensation circuit coupled to said current mirror circuit, comprising third and fourth transistors of a second polarity having current paths coupled respectively to current paths of the first and second transistors, a first resistor coupled to the current path of the third transistor opposite the first transistors, and a second resistor coupled between the current paths of the second and fourth transistors.

2. The CMOS reference voltage circuit according to claim 1, wherein said third and fourth CMOS transistors are configured to operate substantially in a subthreshold region.

3. The CMOS reference voltage circuit according to claim 1, wherein one of said third and fourth transistors is diode connected.

4. The CMOS reference voltage circuit according to claim 1, wherein said fourth transistor is diode connected.

5. The CMOS reference voltage circuit according to claim 1, wherein at least one of said first and second resistors is variable.

6. The CMOS reference voltage circuit according to claim 1, wherein said first resistor is coupled between the source of the third transistor and a voltage supply terminal.

7. The CMOS reference voltage circuit according to claim 1, wherein gates of said third and fourth transistors are interconnected.

8. The CMOS reference voltage circuit according to claim 1, wherein:

a first side of said second resistor is coupled to a drain of said fourth transistor; and a second side of said second resistor is coupled to a drain of said second transistor for generating a reference voltage substantially unaffected by temperature changes.

9. The CMOS reference voltage circuit according to claim 1, wherein said temperature compensation circuit is configured to generate a reference voltage containing a proportional to absolute temperature (PTAT) voltage component and a threshold voltage of said fourth transistor.

10. The CMOS reference voltage circuit according to claim 9, wherein said PTAT voltage component and said threshold voltage have complementary temperature coefficients.

11. The CMOS reference voltage circuit according to claim 9, wherein said PTAT voltage component has a positive temperature coefficient and said threshold voltage has a negative temperature coefficient causing the reference voltage to be substantially unaffected by temperature changes.

12. The CMOS reference voltage circuit according to claim 11, wherein said positive temperature coefficient is proportional to kT/q.

13. The CMOS reference voltage circuit according to claim 1, wherein said first and second transistors are PMOS transistors and said third and fourth transistors are NMOS transistors.

14. The CMOS reference voltage circuit according to claim 1, wherein said first and second transistors are NMOS transistors and said third and fourth transistors are PMOS transistors.

15. The CMOS reference voltage circuit according to claim 1, wherein said current mirror circuit is configured as one of a cascode circuit and a gain boosted circuit.

16. A CMOS temperature compensation circuit, comprising:

first and second transistors having interconnected gates and configured to operate substantially in a subthreshold region, said second transistor being diode connected;

a first resistor coupled between sources of said first and second transistors; and a second resistor having a first end coupled to drain of said second transistor and having a second end coupled to a current mirror circuit for generating a reference voltage that is substantially unaffected by temperature changes.

17. The CMOS temperature compensation circuit according to claim 16, wherein said first resistor and said second resistor are variable.

18. The CMOS temperature compensation circuit according to claim 16, wherein the reference voltage contains a proportional to absolute temperature (PTAT) voltage component and a threshold voltage of said second transistor.

19. The CMOS temperature compensation circuit according to claim 18, wherein said PTAT voltage component and said threshold voltage have complementary temperature coefficients.

20. The CMOS temperature compensation circuit according w claim 19, wherein said PTAT voltage component has a positive temperature coefficient and said threshold voltage has a negative temperature coefficient causing the reference voltage to be substantially unaffected by temperature changes.

21. The CMOS temperature compensation circuit according to claim 20, wherein said positive temperature coefficient is proportional to kT/q.

22. The CMOS temperature compensation circuit according to claim 16, wherein said first and second transistors are NMOS transistors.

23. The CMOS temperature compensation circuit according to claim 16, wherein said first and second transistors are PMOS transistors.

24. An integrated reference voltage circuit, comprising:

a substrate having a current mirror circuit comprising first and second transistors of a first polarity; and a temperature compensation circuit coupled to said current mirror circuit, and comprising a first resistor, a second resistor, and third and fourth transistors of a second polarity, wherein the first resistor is coupled to a current path of the third transistor opposite the current mirror circuit, and wherein the second resistor is coupled between the second and fourth transistors.

25. An integrated CMOS temperature compensation circuit, comprising:

a substrate having first and second transistors with interconnected gates and configured to operate substantially in a subthreshold region, said second transistor being diode connected;

a first resistor coupled between sources of said first and second transistors; and a second resistor having a first end coupled to drain of said second transistor and having a second end coupled to a current mirror circuit for generating a reference voltage that is substantially unaffected by temperature changes.

* * * * *